US011505963B2

(12) United States Patent
Neff et al.

(10) Patent No.: US 11,505,963 B2
(45) Date of Patent: Nov. 22, 2022

(54) SYSTEMS AND METHODS FOR A TENT

(71) Applicant: Jonathan Neff, Edmonds, WA (US)

(72) Inventors: Jonathan Neff, Edmonds, WA (US); Rufus Hartwell, Wales (GB)

( * ) Notice: Subject to any disclaimer, the term of this patent is extended or adjusted under 35 U.S.C. 154(b) by 145 days.

(21) Appl. No.: 17/111,572

(22) Filed: Dec. 4, 2020

(65) Prior Publication Data

US 2021/0172193 A1 Jun. 10, 2021

Related U.S. Application Data

(60) Provisional application No. 62/944,545, filed on Dec. 6, 2019.

(51) Int. Cl.

| | |
|---|---|
| ***E04H 15/38*** | (2006.01) |
| ***E04H 15/42*** | (2006.01) |
| ***E04H 15/36*** | (2006.01) |
| *E04H 15/64* | (2006.01) |

(52) U.S. Cl.

CPC ..... *E04H 15/38* (2013.01); *E04H 15/36* (2013.01); *E04H 15/42* (2013.01); *E04H 15/425* (2013.01); *E04H 15/64* (2013.01)

(58) Field of Classification Search

CPC ..... E04H 15/38

See application file for complete search history.

(56) References Cited

U.S. PATENT DOCUMENTS

| | | | | | |
|---|---|---|---|---|---|
| 1,650,111 | A * | 11/1927 | Byne | E04H 15/003 | 135/120.2 |
| 4,343,322 | A * | 8/1982 | Fiddler | E04H 15/003 | 135/133 |
| 4,739,784 | A * | 4/1988 | Fast | E04H 15/38 | 135/117 |
| 4,915,120 | A * | 4/1990 | Ziolkowski | A47C 7/66 | 135/117 |
| 5,116,288 | A * | 5/1992 | Kondo | A45B 23/00 | 2/9 |
| 5,215,109 | A * | 6/1993 | Kent, Jr. | E04H 15/003 | 135/137 |
| 5,842,495 | A * | 12/1998 | Egnew | E04H 15/38 | 135/147 |
| 6,223,682 | B1 * | 5/2001 | Venier | A62B 33/00 | 116/200 |
| 9,125,350 | B1 * | 9/2015 | Dunn | A01G 9/16 | |
| 2003/0066550 | A1 * | 4/2003 | Al-Ghamdi | E04H 15/40 | 135/132 |
| 2006/0102222 | A1 * | 5/2006 | Zebley | E04H 6/04 | 135/133 |
| 2007/0102032 | A1 * | 5/2007 | Passaro Ponce De Leon | E04H 15/38 | 135/132 |

FOREIGN PATENT DOCUMENTS

| | | | | |
|---|---|---|---|---|
| FR | 1040992 A | * | 10/1965 | |
| GB | 910624 A | * | 11/1962 | |
| GB | 2167462 A | * | 5/1986 | E04H 15/38 |
| WO | WO-2018178454 A1 | * | 10/2018 | A47C 1/14 |

* cited by examiner

*Primary Examiner* — David R Dunn
*Assistant Examiner* — Danielle Jackson
(74) *Attorney, Agent, or Firm* — Pierson IP, PLLC

(57) ABSTRACT

A tent with hubs positioned on the outer circumference of the tent, wherein the hub includes a plurality of pin rings that are configured to independently rotate at offset positions along a rotational axis to incrementally open and close the tent.

20 Claims, 8 Drawing Sheets

SYSTEMS AND METHODS FOR A TENT

BACKGROUND INFORMATION

Field of the Disclosure

Examples of the present disclosure are related to systems and methods for a tent. More particularly, embodiments relate to a tent with hubs positioned on the outer circumference of the tent. The hubs include a plurality of ring pins that are configured to rotate to incrementally open and close the tent.

Background

Conventionally, tents are used as shelter and include sheets of fabric or other materials draped over a frame of poles. Frames for conventional tents are generally static and do not change shape. These frames may include an opening such as a door, flap, etc. positioned on a front end of the tent that has a fixed size. The fixed size of the opening limits the amount of sunlight, access, visibility, temperature control, and covered space a user may have while inside the tent.

However, situations may arise where it is desirable to change the size of an opening associated with the tent, and correspondingly the covered space within the tent. By dynamically changing the opening of the tent, more or less light, shade, and space may be accessible from within the tent, and the temperature within the tent may be controlled.

Accordingly, needs exist for more effective and efficient systems and methods a tent with a dynamic opening, wherein the tent includes hubs with a plurality of ring pins coupled with poles that rotate to change the size and shape of the dynamic opening.

SUMMARY

Embodiments disclosed herein describe systems and methods for a tent with a dynamic opening. The dynamic opening may be configured to rotate to vary the amount of exposure an internal chamber within the tent has to the environment. The dynamic opening may be used to control an amount of wind, shade, visibility, temperature, or other environmental impacts have on the internal chamber of tent while changing a geometrical shape of the outer surface of the tent. In embodiments, the tent may include a webbing, first hub, second hub, frame, and surface.

The webbing may be a bowstring webbing, cloth, rope, etc. that is configured to couple the first hub and the second hub together across an axis of the tent. The webbing may be configured to apply a tension force to the first hub and the second hub towards a center of the webbing. The webbing may be configured to be tightening to simultaneously increase the tension force applied to the first hub in a first direction and the second hub in a second direction, wherein the first direction and the second direction are substantially opposite directions. The tension force generated by the webbing may allow the tent to retain its shape while the dynamic opening changes shapes. In embodiments, the webbing may extend across a diameter, chord or central axis of the tent.

The first hub may be positioned on a first side of the tent, and the second hub may be positioned on the second side of the tent, wherein the first hub and the second hub are mechanically and physically connected to each other via the webbing. Both of the hubs may include a shaft and a plurality of ring pins. Each of the ring pins on a hub may be coupled to a pole. Each of the ring pins may be configured to independently rotate. Based on the rotation of the ring pins, the size and shape of the dynamic opening may change. By changing the size and shape of the dynamic opening, a size and shape of the closure of the tent may dependently change.

In embodiments, each of the ring pins on the first hub may be associated with a corresponding ring pin on the second hub. For example, an outermost ring pin on the first hub may be associated with the outermost ring pin on the second hub, wherein the outermost ring pins are configured to rotate together. In further embodiments, the relative positioning of the ring pins on the hubs may correspond to an angularity of the opening and closing of the dynamic opening. As such, when the dynamic opening is fully closed each of the ring pins may be positioned at different angular offsets around the hub. In embodiments, an angular offset from the innermost ring pin may be oriented one hundred eighty degrees from the outermost ring pin, wherein adjacent ring pins have substantially similar angular offsets between each other. Responsive to partially opening the dynamic opening, the third outermost ring pin may be configured to rotate towards the outermost ring pin and become aligned with the second inner most ring pin. This may also change the angular offset between the innermost ring pin and the outermost ring pin, such that the angular offset decreases. Furthermore, the angular offset between each of the adjacent ring pins between the third outermost ring pin and the innermost ring pins may each decline by a similar amount.

The frame may be positioned on a rear end of the tent and include a first pole coupled to the outermost ring pins on the first and second hub, a second pole coupled to the second outermost ring pins, and a support coupling the first and second poles together. In embodiments, the support may be configured to couple the first and second poles together at a fixed location, which may be a midway point of the first and second poles. By coupling the first and second poles together the angular offset between the outermost ring pins on the first and second hubs and the second outermost ring pins on the first and second hubs may also fixed. This may give the tent a sturdy base that does not allow the outermost ring pins on the first and second hubs and the second outermost ring pins on the first and second hubs to rotate relative to each other. In certain embodiments, this may not allow the dynamic opening to fully expose the surface to the environment. However, in other embodiments, the first and second outermost ring pins of the first and second hubs may be configured to rotate in a similar manner as the other ring pins.

The surface may be configured to be permanently coupled to the first pole on the outermost ring pins on the first and second hub, and selectively coupled to inner pole positioned on the innermost ring pins. Responsive to coupling the surface to the inner pole and rotating the ring pins on the bus to be in a closed position, a chamber within the tent may be closed. Responsive to decoupling the surface to the inner poles, the chamber within the tent may be exposed to the environment.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
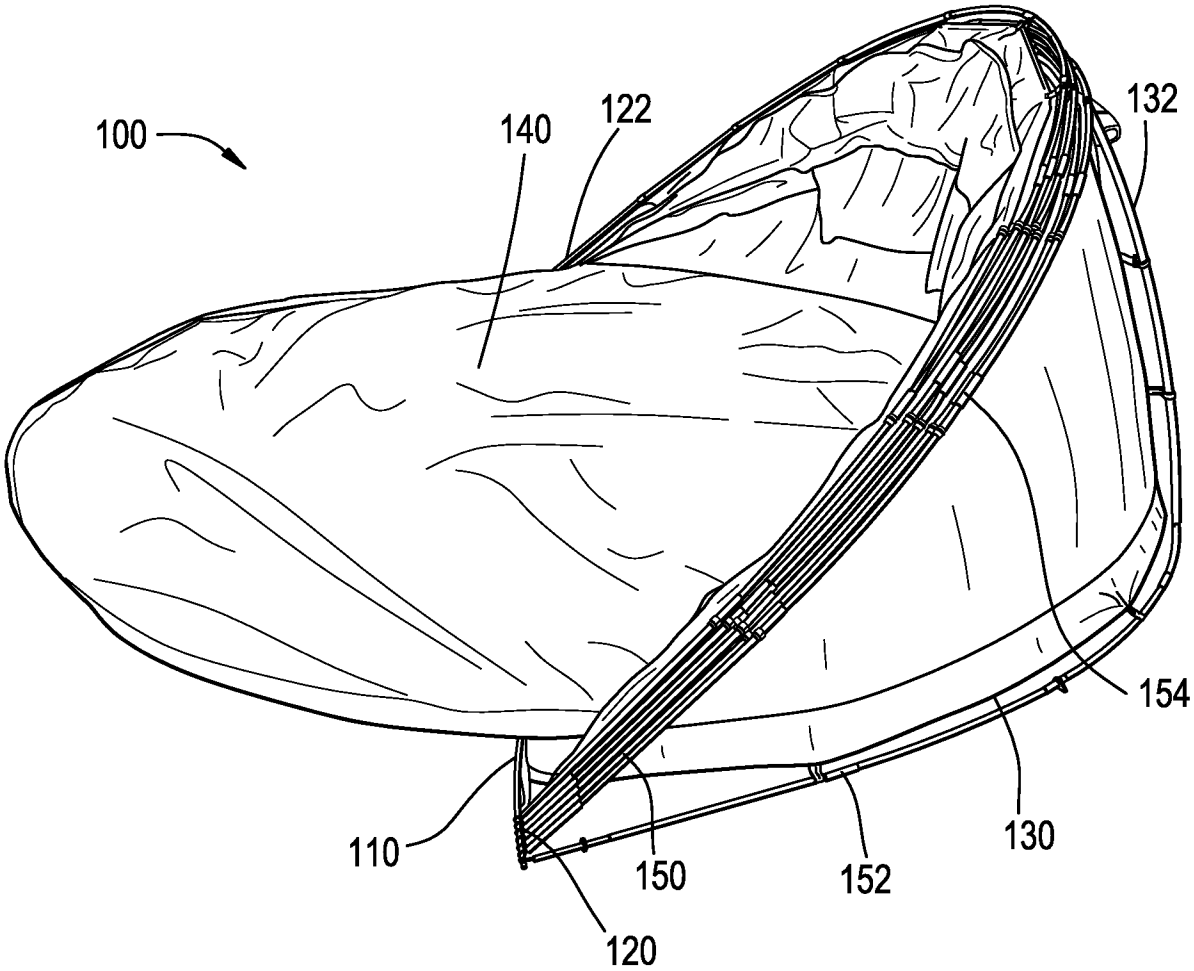
FIG. 1 depicts a tent, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

FIG. 1 depicts a tent 100, according to an embodiment. Tent 100 may be configured to provide shelter to the environment, while exposing more or less an internal chamber within tent 100 to the environment by changing a shape and size of a dynamic opening. Tent 100 may include webbing 110, first hub 120, second hub 122, frame 130, and surface 140.

Webbing 110 may be a bowstring webbing, cloth, rope, fabric, etc. that is configured to couple first hub 120 with second hub 122. Webbing 110 may be configured to apply tension against first hub 120 and second hub 122 in directions towards a center of webbing 110. This applied tension may allow tent 100 to retain its integrity while tent 100 changes shape. In embodiments, the amount of tension applied by webbing 110 may be increased or decreased by dynamically changing a length of webbing 110, wherein shorting the length of webbing 110 may increase the applied tension.

First hub 120 may be positioned on a first side of tent 100 on a first end of webbing 110, and second hub 122 may be positioned on the second side of tent 100 on a second end of webbing 110, wherein first hub 120 and second hub 122 are positioned externally to an edge of surface 140. First hub 120 and second hub 122 may be configured to control a shape of the dynamic opening associated with tent 100 by allowing a series of ring pins to be rotated about an axis. Responsive to rotating the ring pins, the dynamic opening and shape of tent 100 may change. In embodiments, each ring pin on first hub 120 may be coupled to a corresponding ring pin on second hub 122 via a pole, series of poles, etc. (referred to hereinafter collectively and individually as "pole 150"). Responsive to rotating, moving, etc. a first pole coupled to the innermost ring pins on first hub 120 and second hub 122, the dynamic opening may increase or decrease in size.

Frame 130 may be positioned on a rear end of tent 100. Frame 130 may include a support pole 132 that is configured to couple a first pole 152 corresponding to the outermost ring pins on first hub 120 and second hub 122, and a second pole 154 corresponding to the second outermost ring pins on first hub 120 and second hub 122. In embodiments, the support pole 132 may be coupled to an apex of the first pole 152 and the second pole 154 in a somewhat vertical direction. In embodiments, the angular offset between first pole 152 and second pole 154 may be fixed, while the angular offset of the rest of the poles 150 may change.

Responsive to rotating the innermost ring pins on first hub 120 and second hub 122, the innermost ring pins on first hub 120 and second hub 122 may overlap with the second innermost ring pins on first hub 120 and second hub 122. To further increase the size of the dynamic opening, the innermost ring pins on first hub 120 and second hub 122 and corresponding pole may rotate simultaneously with the second innermost ring pins on first hub 120 and second hub 122 and the corresponding pole. Accordingly, when rotating the ring pins on first hub 120 and second hub 122 the other ring pins and corresponding poles may also rotate, and cause subsequent poles and ring pins to overlap each other. For example, when the dynamic opening is fully closed, none of the poles and correspond ring pins may overlap each other. Additionally, when the dynamic opening is fully closed, an angular offset between each of the poles may be somewhat similar. When the dynamic opening has a maximum opening, each of the poles and corresponding ring pins, except the outermost ring pin and correspond first pole 152, may substantially overlap each other. As the dynamic opening moves from a fully closed state to the open most state, more of outer ring pins and correspond poles may incrementally overlap and/or the angular offset between the ring pins and corresponding poles may decrease. This incremental overlap may occur until each of the poles and corresponding ring pins, except for the outermost ring pin and corresponding first pole 152, overlap and are aligned with the fixed position of second pole 154.

Surface 140 may be configured to be a floor surface and closure for the dynamic opening. In a first mode of operation, a first side of surface 140 may be configured to be positioned adjacent to a ground surface (as shown in FIG. 1). This may maximize a sitting area associated with a second side of surface 140. In a second mode of operation, a portion of first side of surface 140 may be positioned adjacent to a ground surface, while a second portion of surface 140 may be coupled to the pole coupled to the innermost ring pins of first hub 120 and second hub 122. As such, responsive to rotating the inner most poles and corresponding ring pins, the second portion of surface 140 may correspondingly rotate to close the internal chamber of tent 100. This may allow the internal chamber of tent 100 to not be directly exposed to the environment, while also allowing the shape and size of the internal chamber within tent 100 to correspondingly change.

Figure 2:
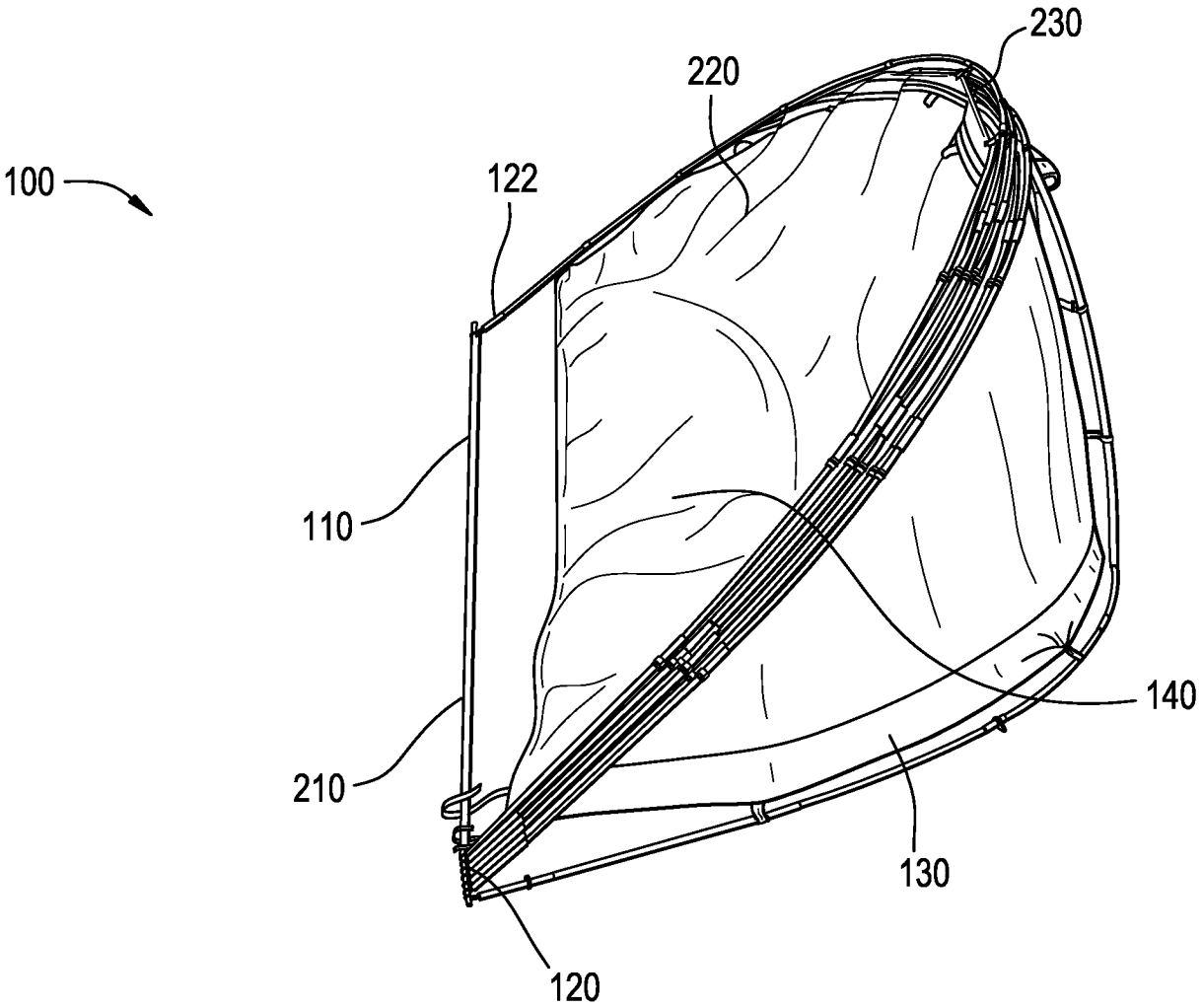
FIG. 2 depicts a tent in the second mode of operation, according to an embodiment.

FIG. 2 depicts tent 100 in the second mode of operation, according to an embodiment. As depicted in FIG. 2, webbing 110 may be coupled to first hub 120 and second hub 122. Further, webbing 110 may be tightened or loosened via buckle 210, or any other fastening mechanism. This may enable tent 100 to be set up and retain proper shape, and correct opened and closed position, even when positioned on uneven terrain, etc.

As further depicted in FIG. 2, a second portion 220 of surface 140 may be coupled to pole 230, wherein pole 230 is coupled to the innermost ring pins on first hub 120 and second hub 122. This may allow second portion 220 to form a closed barrier to the internal chamber within tent 100, wherein the barrier is associated with the opening and closing of the innermost ring pins. In embodiments, when tent 100 is fully closed webbing 110 may not be covered by surface 140.

Figure 3:
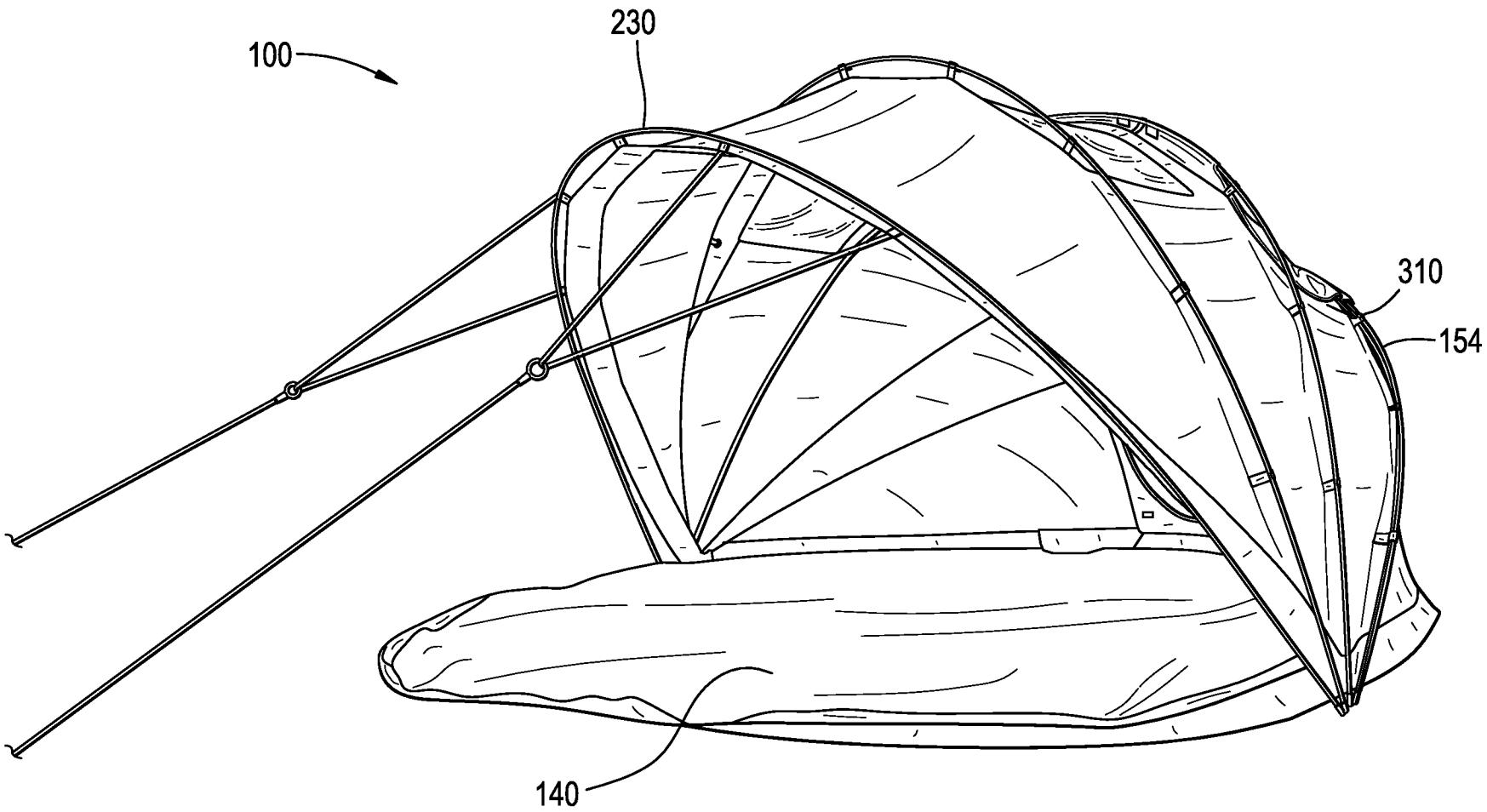
FIG. 3 depicts a tent in a first mode of operation, according to an embodiment.

FIG. 3 depicts tent 100 in a first mode of operation, according to an embodiment. As depicted in FIG. 3, the dynamic opening in front of tent 100 may be partially opened. The dynamic opening may be caused by rotating poles 230 associated with the innermost ring pins on the first hub 120 and the second hub 122 towards the frame 130 on the rear of tent 100. Responsive to rotating poles 230, the other poles may rotate rearward as well, which may cause a pole 310 associated with the third most outward ring pins to overlap with pole 154 associated with the second most outward ring pins.

Figure 4:
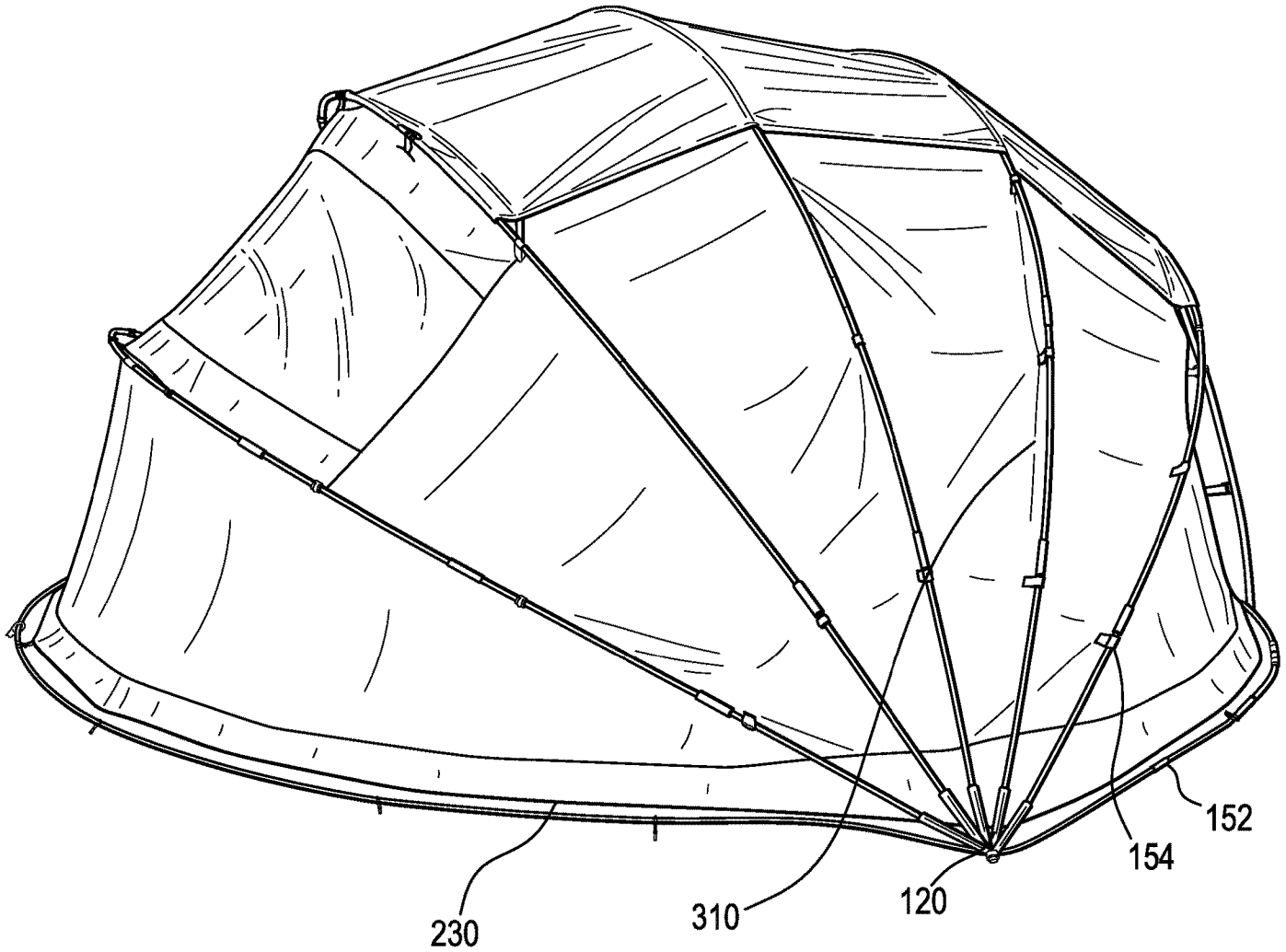
FIG. 4 depicts a tent, according to an embodiment.

FIG. 4 depicts tent 100, according to an embodiment. As depicted in FIG. 4, the dynamic opening of tent 100 may be fully closed. The dynamic opening may be closed by rotating pole 230 associated with the innermost ring pins towards a ground surface. This may cause an angle between adjacent ring pins on the first hub and the second ring hub to be substantially equal.

Figure 5:
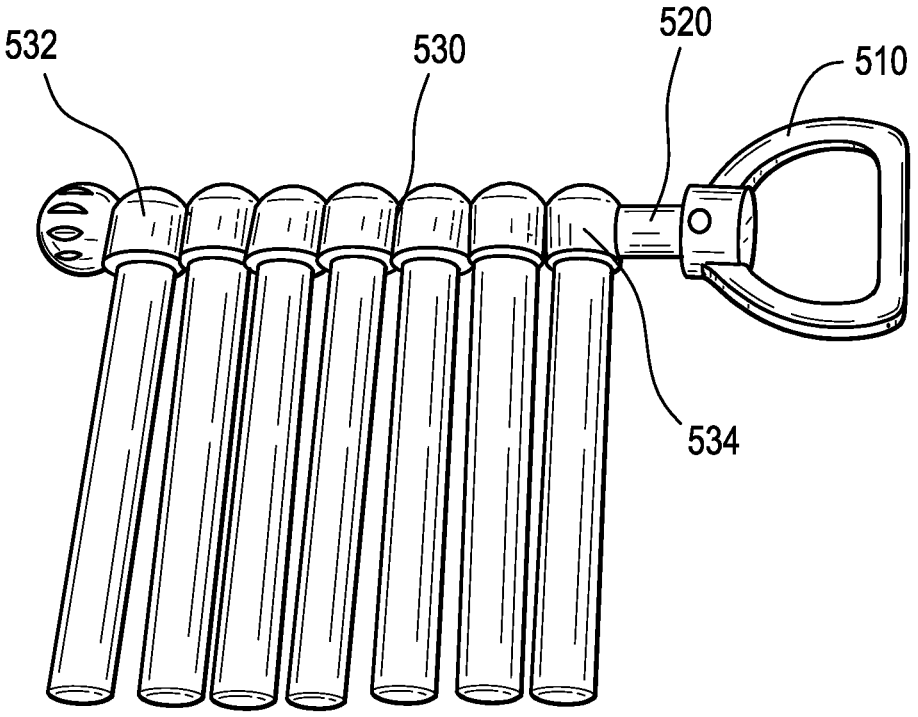
FIG. 5-7 depict a first hub, according to an embodiment.

FIG. 5 depicts first hub 120, according to an embodiment. First hub 120 may include a first coupling mechanism 510, shaft 520, and a series of ring pins 530.

First coupling mechanism 510 may be positioned on a first end of first hub 120 and may be configured to be coupled to the webbing 110 of the tent. In embodiments, first coupling mechanism 510 may include an orifice that is configured to receive a strap of the webbing 110 and a peg. However, in other embodiments, different types of coupling mechanism 510, such as buckles, hook and loops, clasps, etc. may be used. First coupling mechanism 510 may be configured to receive tension forces applied by the webbing 110 to first hub 120.

Shaft 520 may be configured to extend from first coupling mechanism 510 to a second end of first hub 120. Shaft 520 may be configured to provide an axis of rotation for the ring pins 530 to rotate about. In embodiments, shaft 520 may be a rigid shaft with a linear central axis that is fixed. However, in other embodiments, shaft 520 may be formed of a flexible material, such that a central axis of shaft 520 changes based upon an amount of force applied to shaft 520 via ring pins 530 and webbing 110. The bend of shaft 520 may be towards a front end or rear end of tent 100 based on the received forces.

The series of ring pins 530 may be positioned around shaft 520, wherein each of the ring pins 530 may be positioned at various offsets along a longitudinal axis of shaft, and may be configured to independently rotate. The series of ring pins may extend from first coupling mechanism 510 to the second end of first hub 120. Each of the ring pins 530 may extend away from shaft 520, and independently rotate about the axis defined by shaft 520. Each of the ring pins 530 may be configured to be coupled a corresponding pole that extend from a corresponding ring pin on first hub 120 to a corresponding ring pin on a second hub.

In embodiments, an outermost ring pin 532 may be configured to be coupled to a frame 130 positioned at the rear of the tent, and be positioned at a fixed angle that is parallel to a ground surface. An innermost ring pin 534 may be coupled to a pole that defines a front boundary of the dynamic opening of the tent 100. Responsive to innermost ring pin 534 rotating along with the corresponding pole, then the dynamic opening may open or close.

Figure 6:
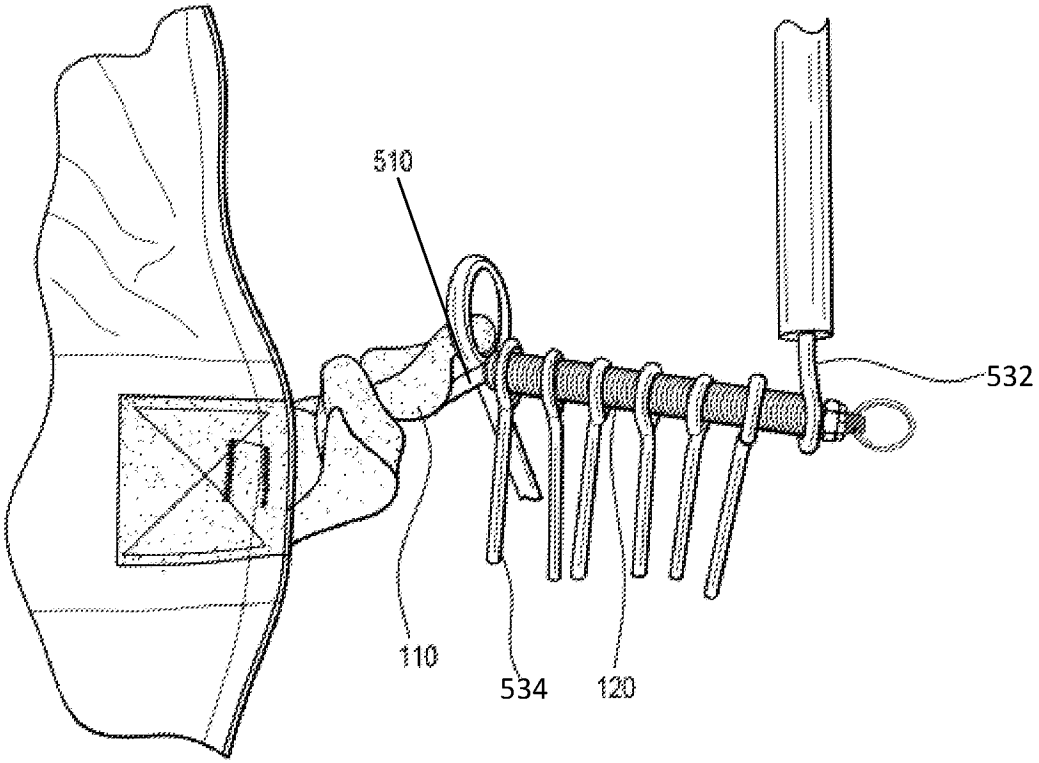
Figure 7:
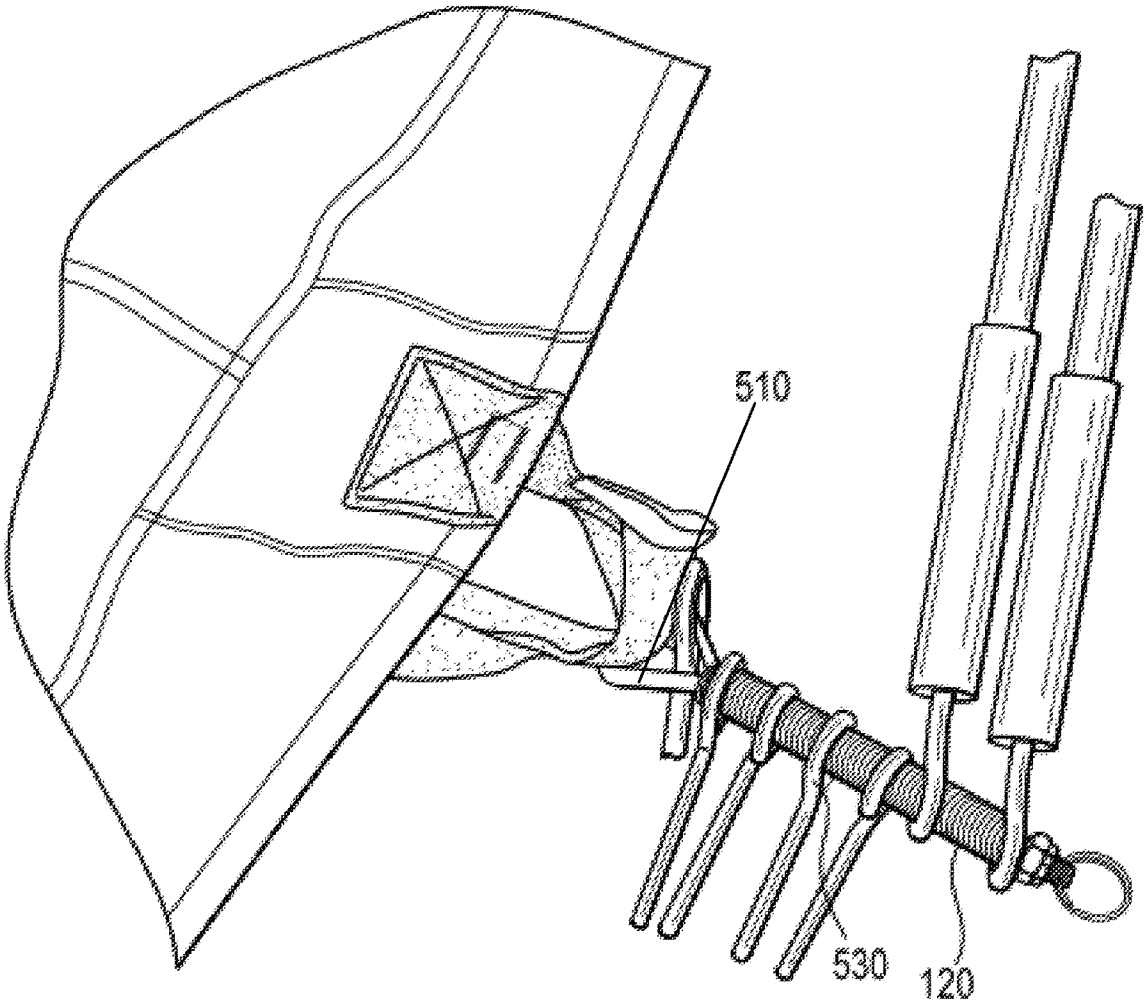

FIGS. 6 and 7 depicts first hub 120, according to an embodiment. As depicted in FIG. 6, coupling mechanism 510 may be coupled to webbing 110, and may also receive a peg to hold first hub 120 in place. Each of the series of pins 530 may be coupled to a corresponding pole that extends from first hub 120 to the corresponding ring pin on the second hub.

Figure 8:
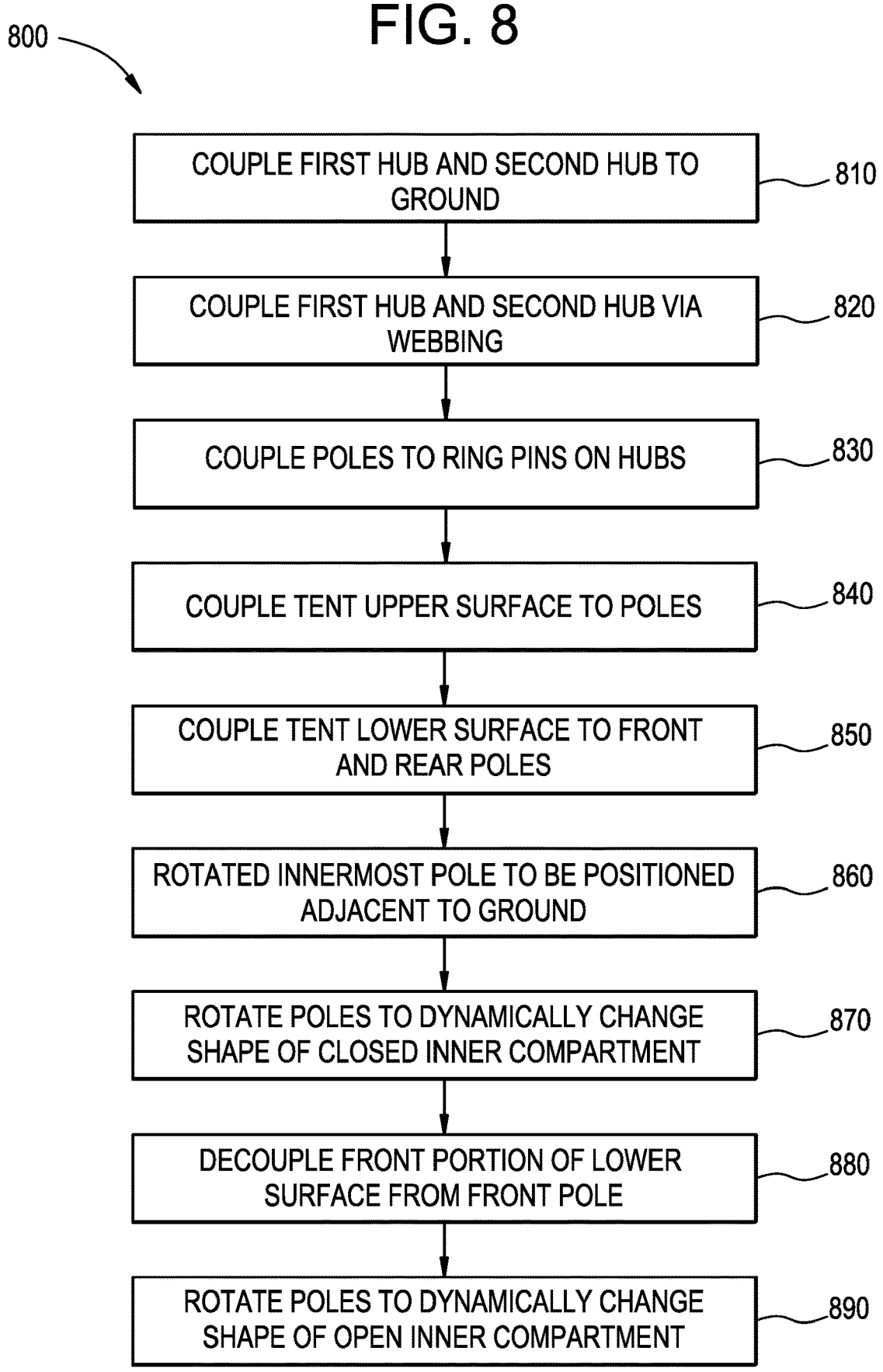
FIG. 8 depicts a method for utilizing a tent, according to an embodiment.

FIG. 8 depicts a method 800 for utilizing a tent, according to an embodiment. The operations of method 800 presented below are intended to be illustrative. In some embodiments, method 800 may be accomplished with one or more additional operations not described, and/or without one or more of the operations discussed. Additionally, the order in which the operations of method 800 are illustrated in FIG. 8 and described below is not intended to be limiting.

At operation 810, a first hub and second hub may be coupled to a ground surface. The first hub and second hub may be coupled to the ground surface via stakes, peg, etc. The pegs may be positioned on an innermost edge of shafts associated with the first hub and second hub.

At operation 820, webbing may be utilized to couple a first hub with a second hub. The webbing may be tightened to apply a desired amount of torsion force against the first hub in a first direction and the second hub in a second direction, wherein the first direction and second direction face a center of the tent.

At operation 830, a pole may be coupled to the outermost ring pins on the first hub and the second hub. Then a pole may be coupled to the next outermost ring pins on the first hub and second hub. Next, the subsequent innermost ring pins on the first hub and second hub may couple to corresponding poles.

At operation 840, a tent material may be coupled to each of the poles and hubs. The tent material may be any type of fabric, which may be waterproof, breathable, etc.

At operation 850, a rear portion of a surface of the tent may be coupled to the outermost pole and front portion of the surface of the tent may be coupled to the innermost pole. This may close an internal compartment within the tent.

At operation 860, the innermost pole may be rotated to maximize an angular offset between the innermost pole and the outermost pole. This may increase the size of the internal compartment within the tent, while the tent remains closed. This may cause the surface to be positioned flush against a ground surface.

At operation 870, the third outermost pole may be rotated rearward to be overlapped with the second outermost pole. Responsive to overlapping the third outermost pole and second outermost pole, and angular offset between the innermost pole and the third outermost pole, as well as the outermost pole, may decrease. Furthermore, the angular offsets between each of the poles between the innermost pole and the third outermost pole may correspondingly decrease in a somewhat similar angle. By decreasing the angular offset between the innermost pole and the outermost pole the size of the internal compartment may decrease, and the front portion of the surface may be elevated off the ground surface.

At operation 880, a front portion of the surface may be decoupled from the first pole. This may expose a portion of the internal compartment to the elements. Responsive to decoupling the surface from the first pole, an entirety of the surface may be positioned adjacent to the ground surface.

At operation 890, a fourth outermost pole may be rotated towards the overlapping second and third outermost poles. This may further decrease the angular offset between the innermost pole and the outermost pole.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A tent comprising:

a first hub with a first shaft and a first plurality of ring pins;

a second hub with a second shaft and a second plurality of ring pins;

webbing formed of fabric configured to couple the first hub and the second hub, the webbing being configured to apply a first torsion force against the first hub in a first direction and apply a second torsion force against the second hub in a second direction, the first direction and the second direction being opposite directions;

a first outermost pole being configured to be coupled with a first outermost ring pin of the first plurality of ring pins and a second outermost ring pin of the second plurality of ring pins, the first outermost pole being configured to be fixed in place;

an innermost pole being configured to be coupled with a first innermost ring pin of the first plurality of ring pins and a second innermost ring pin of the second plurality of ring pins, the innermost pole being configured to rotate to increase or decrease an angular offset between the innermost pole and the first outermost pole.

2. The tent of claim 1, further comprising:

a second outermost pole being configured to be coupled with the first hub and the second hub, the second outermost pole being configured to be fixed in place;

a tent support being configured to couple the second outermost pole and the first outermost pole at an apex of the second outermost pole.

3. The tent of claim 2, wherein the first plurality of pins includes at least five ring pins, the at least five pins including the innermost ring pin, the outermost ring pin, a second ring pin, a third ring pin, and a fourth ring pin, the second outermost pole being coupled with the fourth ring pin.

4. The tent of claim 3, wherein the innermost ring pin, second ring pin, and third ring pin are configured to rotate separately from each other, the second ring pin being positioned between the innermost ring pin and the third ring pin, the third ring pin being positioned adjacent to the fourth ring pin.

5. The tent of claim 4, further comprising:

a second pole being configured to be coupled with the second ring pin;

a third pole being configured to be coupled with the third ring pin; and a fourth pole being configured to be coupled with the fourth ring pin, wherein the innermost pole, the second pole and the third pole are configured to be rotated to be overlapped with the second outermost pole.

6. The tent of claim 5, further comprising:

a surface having a first portion coupled to the outermost pole, and a second portion selectively coupled to the innermost pole.

7. The tent of claim 6, wherein in a first mode the second portion is coupled to the innermost pole to close an internal compartment within the tent, and in a second mode the second portion is decoupled to the innermost pole to expose the internal compartment within the tent.

8. The tent of claim 1, wherein a volume of an internal compartment within the tent is configured to dynamically change based on the angular offset between the innermost pole and the first outermost pole.

9. The tent of claim 8, wherein the volume of the internal compartment is configured to incrementally decrease responsive to decreasing the angular offset between the innermost pole and the first outermost pole, and the volume of the internal compartment is configured to increase responsive to increasing the angular offset between the innermost pole and the first outermost pole.

10. The tent of claim 1, wherein the first hub further includes a coupling mechanism and a shaft, the coupling mechanism being configured to be coupled to the webbing and receive a stake, wherein the first plurality of ring pins are configured to rotate about the shaft such that each of the first plurality of ring pins have a same axis of rotation defined by a central axis of the shaft, wherein the central axis of the shaft extends in a same direction as the webbing.

11. A method for using a tent comprising:

coupling, via a webbing formed of fabric, a first hub with a second hub, the first hub including a first shaft and a first plurality of ring pins, the second hub including a second shaft and a second plurality of ring pins;

applying, via the webbing, a first torsion force against the first hub in a first direction and applying a second torsion force against the second hub in a second direction, the first direction and the second direction being opposite directions;

coupling a first outermost pole with a first outermost ring pin of the first plurality of ring pins and a second outermost ring pin of the second plurality of ring pins;

fixing the first outermost pole in place;

coupling an innermost pole with a first innermost ring pin of the first plurality of ring pins and a second innermost ring pin of the second plurality of ring pins;

rotating the innermost pole being to increase or decrease an angular offset between the innermost pole and the first outermost pole.

12. The method of claim 11, further comprising:

coupling a second outermost pole with the first hub and the second hub, the second outermost pole being configured to be fixed in place;

coupling the second outermost pole and the first outermost pole at an apex of the second outermost pole via a tent support.

13. The method of claim 12, wherein the first plurality of ring pins includes at least five ring pins, the at least five pins including the innermost ring pin, the outermost ring pin, a second ring pin, a third ring pin, and a fourth ring pin, the second outermost pole being coupled with the fourth ring pin.

14. The method of claim 13, further comprising:

rotating the innermost ring pin, second ring pin, and third ring pin separately from each other, the second ring pin being positioned between the innermost ring pin and the third ring pin, the third ring pin being positioned adjacent to the fourth ring pin.

15. The method of claim 14, further comprising:

coupling a second pole with the second ring pin;

coupling a third pole with the third ring pin;

coupling a fourth pole with the fourth ring pin;

rotating the innermost pole, the second pole and the third pole to be overlapped with the second outermost pole.

16. The method of claim 15, further comprising:

coupling a first portion of a surface with the outermost pole; and coupling a second portion of the surface with the innermost pole.

17. The method of claim 16, wherein in a first mode the second portion is coupled to the innermost pole to close an internal compartment within the tent, and in a second mode the second portion is decoupled to the innermost pole to expose the internal compartment within the tent.

18. The method of claim 11, further comprising:

dynamically changing a volume of an internal compartment within the tent based on the angular offset between the innermost pole and the first outermost pole.

19. The method of claim 18, wherein the volume of the internal compartment is configured to incrementally decrease responsive to decreasing the angular offset between the innermost pole and the first outermost pole, and the volume of the internal compartment is configured to increase responsive to increasing the angular offset between the innermost pole and the first outermost pole.

20. The method of claim 11, wherein the first hub further includes a coupling mechanism and a shaft, the coupling mechanism being configured to be coupled to the webbing and receive a stake, wherein the first plurality of ring pins are configured to rotate about the shaft such that each of the first plurality of ring pins have a same axis of rotation defined by a central axis of the shaft, wherein the central axis of the shaft extends in a same direction as the webbing.

* * * * *